US011577355B2

(12) United States Patent
De Silva et al.

(10) Patent No.: US 11,577,355 B2
(45) Date of Patent: Feb. 14, 2023

(54) CLOSED CHAMBER ABRASIVE FLOW MACHINE SYSTEMS AND METHODS

(71) Applicant: The Boeing Company, Chicago, IL (US)

(72) Inventors: Kandaudage Channa Ruwan De Silva, Summerville, SC (US); Kevin Thomas Slattery, Saint Peters, MO (US)

(73) Assignee: The Boeing Company, Chicago, IL (US)

( * ) Notice: Subject to any disclaimer, the term of this patent is extended or adjusted under 35 U.S.C. 154(b) by 706 days.

(21) Appl. No.: 15/859,173

(22) Filed: Dec. 29, 2017

(65) Prior Publication Data

US 2019/0202023 A1 Jul. 4, 2019

(51) Int. Cl.

| | |
|---|---|
| ***B24B 31/116*** | (2006.01) |
| ***B24C 1/04*** | (2006.01) |
| ***B24C 1/08*** | (2006.01) |
| ***B24B 31/00*** | (2006.01) |

(52) U.S. Cl.

CPC ..... *B24B 31/003* (2013.01); *B24B 31/116* (2013.01); *B24C 1/04* (2013.01); *B24C 1/08* (2013.01)

(58) Field of Classification Search

CPC ..... B24C 1/04; B24C 1/08; B24C 7/0007; B24C 9/00; B24B 31/00; B24B 31/003; B24B 31/116

USPC ..... 451/29, 36, 38, 54, 74, 89, 104, 113

See application file for complete search history.

(56) References Cited

U.S. PATENT DOCUMENTS 3,039,234 A * 6/1962 Balman ..... B24B 31/116 451/36
3,328,925 A * 7/1967 Hewitt ..... B24C 1/04 451/31
3,589,071 A * 6/1971 Hirschhorn ..... B24B 13/00 451/36
4,360,990 A * 11/1982 Hubbard ..... B24C 3/04 451/2
5,070,652 A * 12/1991 Rhoades ..... B24B 31/116 451/36

(Continued)

FOREIGN PATENT DOCUMENTS

CA 2393199 A1 9/2001
CN 202894971 U 4/2013

(Continued)

OTHER PUBLICATIONS

Sankar et al., "Abrasive flow machining (AFM): An Overview", Jan. 2011, 10 pages [online], Retrieved from the Internet: <URL:https://www.researchgate.net/publication/228747468>.

(Continued)

*Primary Examiner* — Eileen P Morgan
(74) *Attorney, Agent, or Firm* — Haynes and Boone, LLP

(57) ABSTRACT

Systems and methods are provided for viscous and/or chemically erosive flow machining of work pieces. In certain examples, a tool for flow machining may be disclosed. The tool may include a cavity configured to receive a work piece and one or more inlets and outlets for viscous media flow. Viscous media and/or chemically erosive media can be flowed into the cavity and, via a media flow path, can be used to machine the work piece.

21 Claims, 8 Drawing Sheets

(56) References Cited

U.S. PATENT DOCUMENTS

| | | | | |
|---|---|---|---|---|
| 5,125,191 | A * | 6/1992 | Rhoades | B24B 1/00 451/113 |
| 5,746,691 | A * | 5/1998 | Frantzen | A61F 2/91 600/36 |
| 5,788,558 | A * | 8/1998 | Klein | B24B 31/116 451/113 |
| 6,273,787 | B1 * | 8/2001 | Gilmore | B24B 31/116 451/104 |
| 6,905,395 | B2 * | 6/2005 | Walch | B24B 49/16 451/113 |
| 6,953,387 | B2 * | 10/2005 | Greenslet | B24B 31/116 451/36 |
| 8,556,681 | B2 * | 10/2013 | Banks | C23C 14/3414 451/59 |
| 9,623,539 | B2 * | 4/2017 | Robinson | B24C 9/00 |
| 9,687,953 | B2 * | 6/2017 | Sun | B24B 31/003 |
| 9,793,613 | B2 * | 10/2017 | Wilson | H01Q 13/00 |
| 10,065,289 | B2 * | 9/2018 | Chinnakaruppan | B24B 31/116 |
| 10,335,922 | B2 * | 7/2019 | Phatak | B24C 3/322 |
| 2004/0266320 | A1 * | 12/2004 | Walch | B24B 49/16 451/36 |
| 2006/0105682 | A1 * | 5/2006 | Bowman | G05D 7/0635 451/36 |
| 2013/0295822 | A1 * | 11/2013 | Robinson | B24C 9/00 451/89 |
| 2015/0097746 | A1 * | 4/2015 | Wilson | H01Q 13/00 343/772 |
| 2016/0001420 | A1 * | 1/2016 | Robinson | B24C 9/00 451/38 |

FOREIGN PATENT DOCUMENTS

| | | |
|---|---|---|
| CN | 103612166 | 3/2014 |
| CN | 107052980 | 8/2017 |
| TW | 200502441 A | 1/2005 |
| WO | WO 2014/143302 | 9/2014 |

OTHER PUBLICATIONS

First Office Action in China Application No. 201811617065.5 dated Jan. 11, 2022, with English translation.

Examination Report in India Application No. 201814042433 dated Mar. 2, 2022.

* cited by examiner

CLOSED CHAMBER ABRASIVE FLOW MACHINE SYSTEMS AND METHODS

TECHNICAL FIELD

The disclosure relates generally to work piece processing and more specifically, for example, to aircraft component processing utilizing abrasive flow machining.

BACKGROUND

Aircraft components often include complicated geometries with stringent surface finish requirements. High throughput and low cost are also desirable in the manufacturing of such components. Abrasive flow machining can be used to surface smooth interior channels, but can round sharp edges, build up residue in bends, swell the component due to pressure, and currently can only be used to machine interior surfaces and not exterior surfaces.

SUMMARY

Systems and methods are disclosed herein for viscous media flow machining tools. In a certain example, an apparatus can be described and can include a tool body including a cavity and a work piece holder disposed within the cavity and configured to receive a work piece. The apparatus can additionally include a seal door configured to move between a first position allowing access to the cavity and a second position preventing access to the cavity, a first viscous media entry configured to couple to a viscous media source and allow viscous media to flow into the cavity, and a first viscous media exit configured to allow the viscous media to flow out of the cavity. The first viscous media entry can be a first point in a media flow path of the viscous media and the viscous media exit can be a second point in the media flow path downstream of the first point. The work piece holder can be configured to hold the work piece within the media flow path to be machined by the viscous media.

In another example, a method can be described that includes determining a geometry of a tool body comprising a cavity and a work piece holder disposed within the cavity and configured to receive a work piece, determining a starting geometry of the work piece, determining characteristics of a viscous media, determining a media flow path of the viscous media within the cavity when the work piece holder within the cavity receives the work piece, and determining machining characteristics of the media flow path of the viscous media on the work piece.

The scope of the invention is defined by the claims, which are incorporated into this section by reference. A more complete understanding of the disclosure will be afforded to those skilled in the art, as well as a realization of additional advantages thereof, by a consideration of the following detailed description of one or more implementations. Reference will be made to the appended sheets of drawings that will first be described briefly.

BRIEF DESCRIPTION OF THE DRAWINGS

Examples of the disclosure and their advantages are best understood by referring to the detailed description that follows. It should be appreciated that like reference numerals are used to identify like elements illustrated in one or more of the figures.

DETAILED DESCRIPTION

Systems and techniques for viscous media flow machining (e.g., abrasive flow machining) and/or chemically erosive flow machining are described in the disclosure herein in accordance with one or more examples. Such machining can machine interior and/or exterior surfaces of components. Additionally, systems and techniques for configuring the flow paths of various tools used in viscous media flow machining and/or chemically erosive flow machining are also described.

The systems and techniques described herein allow for component manufacture, especially for aircraft components. Such systems and techniques allow for broader application of flow machining as flow machining can be used for both interior and exterior surfaces without swelling. Additionally, such flow machining can be accordingly configured to allow for desirable geometries such as edges.

The tools described herein can be configured to allow for flow machining of both exterior and interior surfaces of work pieces. The tools described herein include cavities specifically configured to direct viscous or chemically erosive media flow over the outer surfaces of work pieces to allow for forming and/or machining of the outer surfaces of the work pieces. Additionally, such control can avoid residue, swell, and unintended rounding of corners of work pieces.

For the purposes of this disclosure, systems and techniques described for viscous media machining may also be used for chemically erosive machining. Furthermore, viscous media and chemically erosive machining may be used separately or as a combination. As such, systems and techniques described herein may use only viscous media, only chemically erosive media, or a combination of both.

Figure 1:
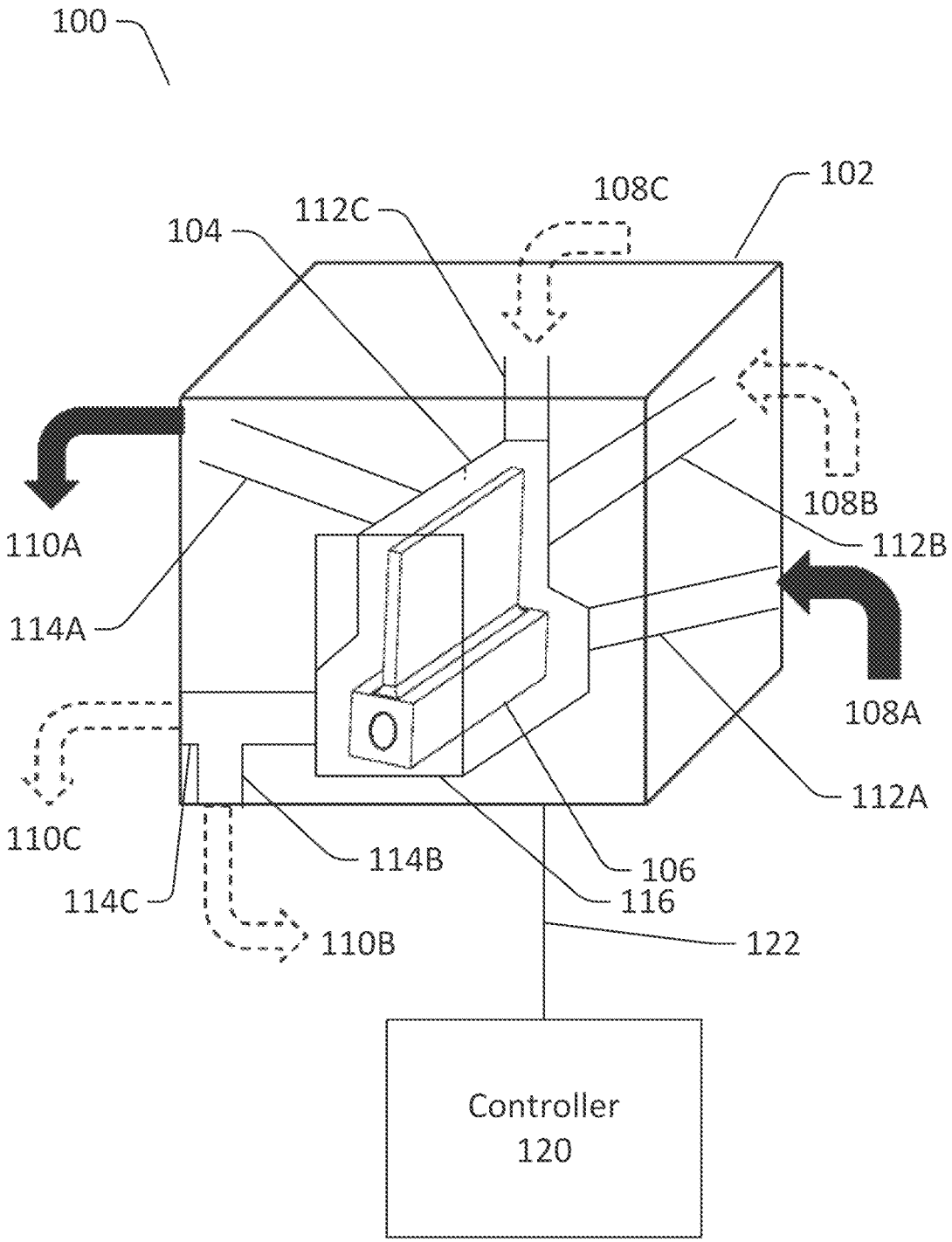
FIG. 1 illustrates a viscous media machining tool in accordance with an example of the disclosure.

As an illustrative example, FIG. 1 illustrates a viscous media machining tool in accordance with an example of the disclosure. FIG. 1 illustrates tool 100, which includes tool body 102 and controller 120 communicatively connected to tool body 102 via communications channel 122.

Tool body 102 includes a cavity 104. Cavity 104 can be configured to hold work piece 106. In certain examples, work piece 106 can be held within cavity 104 by one or more work piece holders. The work piece holders can hold work piece 106 in a substantially stable position while viscous media flows through cavity 104. Access to cavity 104 is controlled by seal door 116. When seal door 116 is open, cavity 104 can be accessed and, thus, work piece 106 can be loaded into cavity 104. When seal door 116 is closed, cavity 104 can be sealed except for flow of viscous media into cavity 104. Thus, when seal door 116 is closed, viscous media can flow within cavity 104 and machine and/or form work piece 106.

Cavity 104 is connected to viscous media entries 112A-C and viscous media exits 114A-C. While the example shown in FIG. 1 illustrates three viscous media entries and three viscous media exits, other examples can include any number of viscous media entries and exits. Viscous media entries 112A-C can be connected to one or more viscous media sources and can form one or more pathways for viscous media to enter cavity 104. Viscous media exits 114A-C can form one or more pathways for viscous media to exit cavity 104 (e.g., after machining work piece 106) to one or more disposals that can collect the viscous media.

A viscous media source can provide for the viscous media that flows into cavity 104. As shown in FIG. 1, each of viscous media entries 112A-C is connected to one of viscous media sources 108A-C, but other examples can include any number (e.g., one, two, four or more) of viscous media sources. Viscous media collectors (e.g., viscous media collectors 110A-C) couple to viscous media exits 114A-C to receive viscous media that has exited cavity 104. In certain examples, viscous media that exits cavity 104 can be routed to re-enter cavity 104 through viscous media entries 112A-C.

Viscous media can flow through cavity 104 via one or more flow paths. One of viscous media entries 112A-C can define a first point in one of the flow paths and one of viscous media exits 114A-C can define a second point in one of the flow paths. As such, viscous media can flow from one of the viscous media entries 112A-C through cavity 104, form, wear, and/or machine work piece 106, and flow to one of viscous media exits 114A-C. Such viscous media flow paths can be configured to allow for the flow of viscous media to wear away, shape or otherwise form (e.g., machine) work piece 106.

Cavity 104 can include a work piece holder to hold work piece 106 within the media flow path(s). The work piece holder can securely hold work piece 106 so that viscous media flow does not move or substantially move (e.g., include movement above, for example, 1 inch of distance) work piece 106 and so viscous media flow can be used to accurately wear away, shape or otherwise form (e.g., machine) work piece 106.

Tool body 102 can include a shaping portion to direct flow of viscous media. In certain examples, the shaping portion may be, for example, cavity 104 or portions thereof. As such, cavity 104 can include one or more features that can affect flow of viscous media. Such features can affect flow of viscous media within cavity 104 to wear away, shape or otherwise form (e.g., machine) work piece 106 so that work piece 106, after processing within tool 100 by viscous media flow, conforms to a desired shape.

Flow of viscous media within cavity 104 as well as other operation of tool 100 can be controlled by controller 120. Controller 120 can include, for example, a single-core or multi-core processor or microprocessor, a microcontroller, a logic device, a signal processing device, memory for storing executable instructions (e.g., software, firmware, or other instructions), and/or any elements to perform any of the various operations described herein. In various examples, controller 120 and/or its associated operations can be implemented as a single device or multiple devices (e.g., communicatively linked through analog, wired, or wireless connections such as through one or more communication channels such as via data connection 112) to collectively constitute the controller 120.

Controller 120 can include one or more memory components or devices to store data and information. The memory can include volatile and non-volatile memory. Examples of such memories include RAM (Random Access Memory), ROM (Read-Only Memory), EEPROM (Electrically-Erasable Read-Only Memory), flash memory, or other types of memory. In certain examples, controller 120 can be adapted to execute instructions stored within the memory to perform various methods and processes described herein, including implementation and execution of control algorithms responsive to sensor and/or operator (e.g., flight crew) inputs. Thus, controller 120 can store instructions for the operation of tool 100 as well as provide instructions to various components of tool 100 for operation thereof at the appropriate time.

Figure 2:
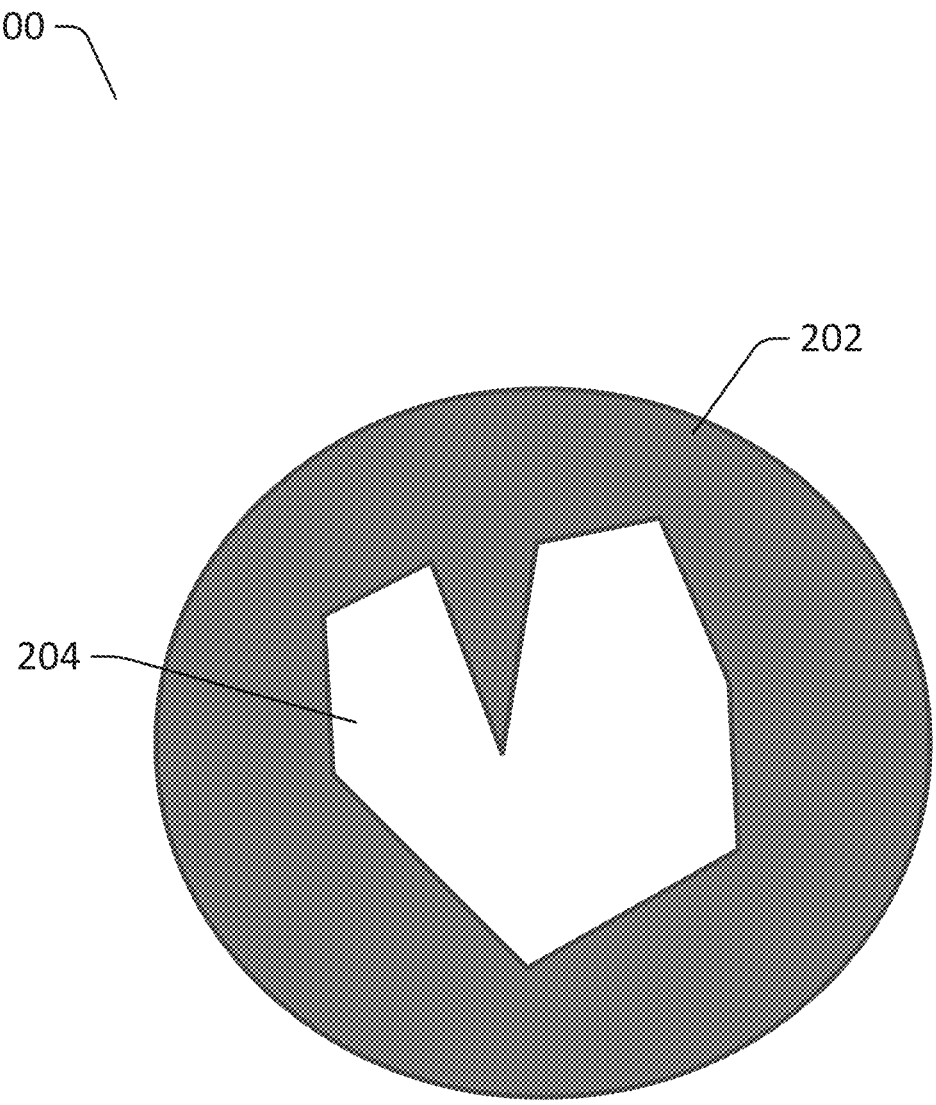
FIG. 2 illustrates a front view of a tool body in accordance with an example of the disclosure.

Controller 120 is communicatively coupled to tool 100 via data connection 112. Data connection 112 can include one or more of analog, wired, or wireless connections such as Bluetooth, WiFi, Near Field Communications, or via network communications through an Internet Service Provider or data connection (e.g., 3G, 4G, LTE, or other connections). Data connection 112 can thus be any connection FIG. 2 illustrates a front view of a tool body in accordance with an example of the disclosure. FIG. 2 illustrates a single piece tool body 200. Tool body 200 includes a body portion 202 and a cavity 204. Cavity 204 is a void within body portion 202. Cavity 204 can be configured to receive a work piece.

Cavity 204 can include one or more features configured to control flow of viscous media within cavity 204. For example, cavity 204 can include one or more protrusions, cavities, voids, and/or other features that direct flow of viscous media around any work piece held within cavity 204.

Figure 3A:
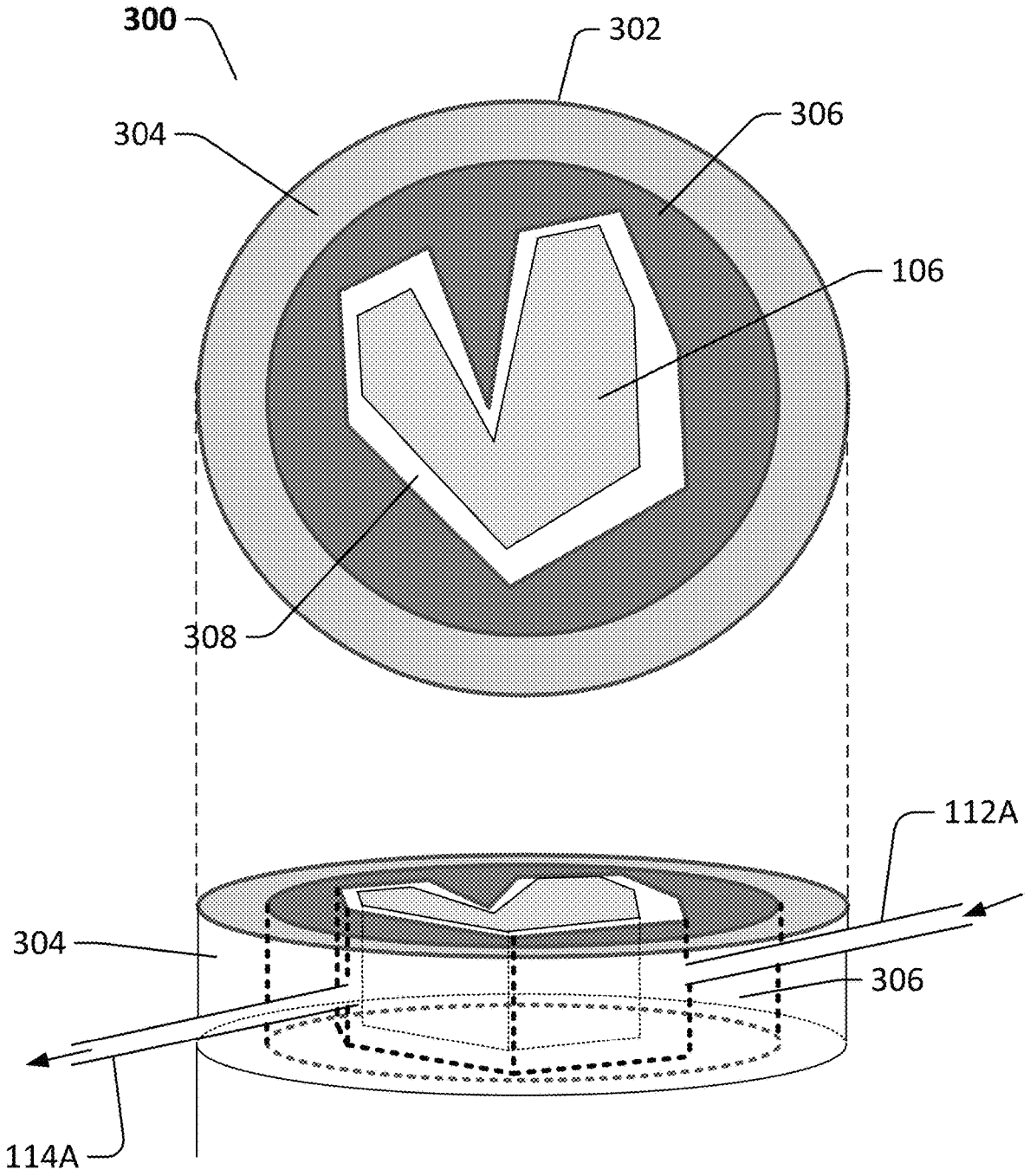
FIG. 3A illustrates a front view of a two part tool body in accordance with an example of the disclosure.

FIG. 3A illustrates a front view of a two part tool body in accordance with an example of the disclosure. Tool body 302 is a two part tool 300 that includes a stiffening portion 304 and a shaping portion 306. Stiffening portion 304 is configured to receive shaping portion 306 to provide additional structural support to shaping portion 306 during operation of tool 100. Thus, stiffening portion 304 can support shaping portion 306 so that, during operation of 100 and flow of the viscous media, shaping portion 306 does not expand in an unwanted manner.

In some such examples, stiffening portion 304 and shaping portion 306 can be made from different materials or be structurally different (e.g., stiffening portion 304 can be a lattice structure while shaping portion 306 can be a solid structure). Such differences can allow for shaping portion 306 to be configured to interact or contain the viscous media while allowing for stiffening portion 304 to be configured to not interact with the viscous media and to be configured to support shaping portion 306.

Shaping portion 306 can include cavity 308. Cavity 308 can be configured to receive a work piece as well as viscous media flow. As viscous media can wear tool surfaces, the surfaces in cavity 308 or portions thereof can be configured to be consumable or wear away and, thus, shaping portion 306 can be configured to be replaceable. Shaping portion 306 can be configured to be replaced when features of cavity 308 exhibit wear below a maximum wear level. In certain examples, such a maximum wear level can be a level where, if there is further wear past the maximum wear level, the forming of the work piece by viscous media flow is affected.

In such an example, the shaping portion 306 can be configured to decouple from stiffening portion 304 to facilitate replacement of shaping portion 306. The shaping portion 306 can be coupled to stiffening portion 304 through adhesives, mechanical fasteners, welding, or other attachment techniques and such attachments can be decoupled to allow removal of shaping portion 306 from stiffening portion 304.

Figure 3B:
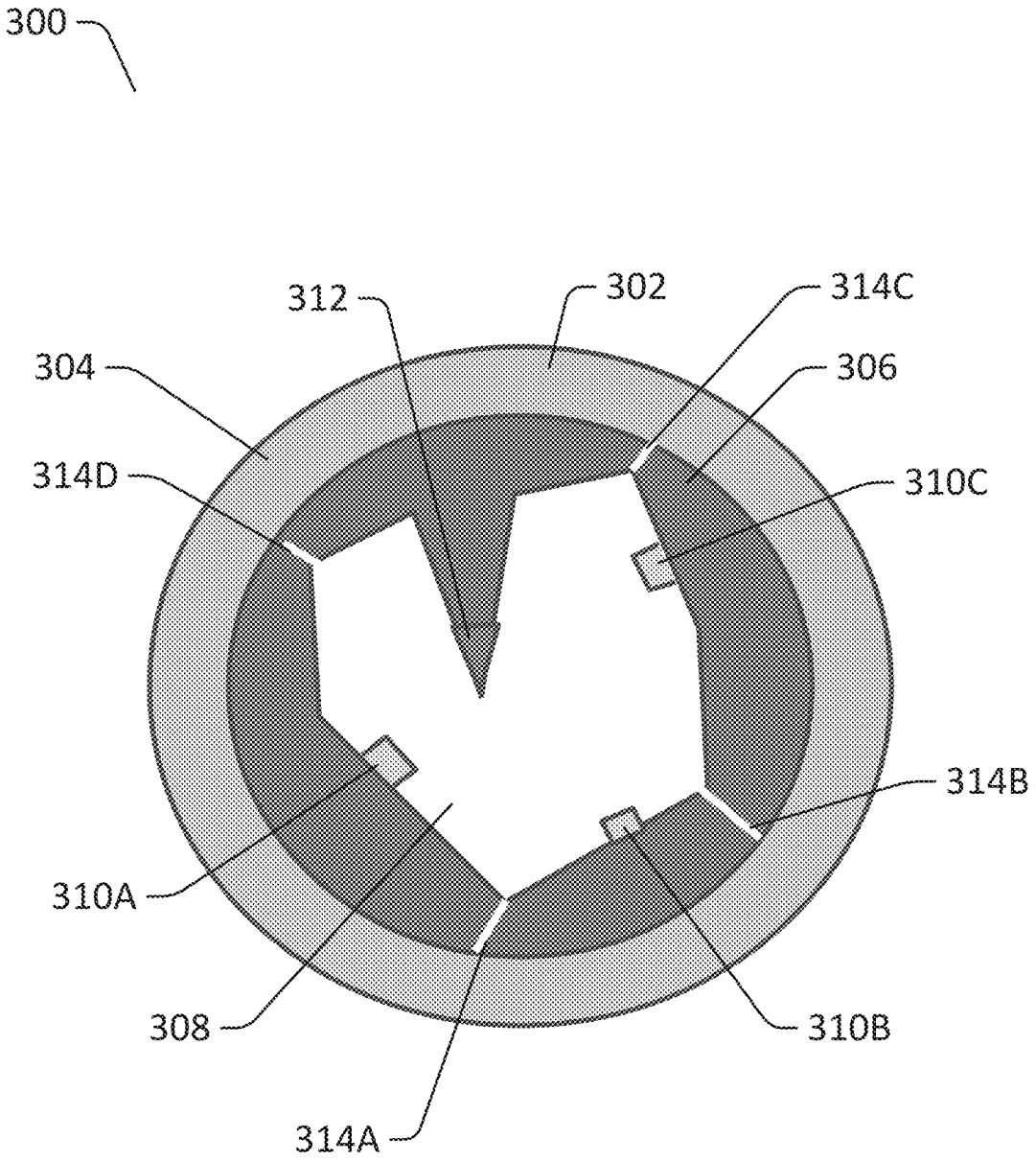
FIG. 3B illustrates a front view of another tool body in accordance with an example of the disclosure.

FIG. 3B illustrates a front view of another tool body in accordance with an example of the disclosure. FIG. 3B illustrates tool body 302 of FIG. 3A with further features. Such further features include work piece holders 310A-C, insert 312, and cut-outs 314A-D.

Work piece holders 310A-C are configured to hold a work piece. Each of work piece holders 310A-C can be configured to couple to a different portion of the work piece. Thus, work piece holders 310A-C can securely hold the work piece within cavity 308 and prevent substantial movement of the work piece within cavity 308 when held. Work piece holders 310A-C can include, for example, mechanical fasteners, features such as angled pieces, clamps, pins and/or dowels, magnets, and/or other such components or devices for holding of a work piece. While the example shown in FIG. 3B includes work piece holders 310A-C, other examples can include any number of work piece holders.

Insert 312 can be configured to couple to one or more features of cavity 308. Insert 312 can be coupled via adhesive, mechanical fasteners, welding, magnetically, or through other fastening techniques to one or more features of cavity 308. In certain examples, cavity 308 can be configured to receive insert 312 (e.g., through cutouts within cavity 308, studs disposed within cavity 308, features configured to receive or engage with fasteners, and/or other such features configured to receive or couple insert 312 to one or more features of cavity 308).

Insert 312 can be configured to be worn by viscous media flow and be replaced if wear of insert 312 is, for example, at a wear threshold or beyond a wear threshold. In certain examples, insert 312 can be configured to be disposed at a high wear area of cavity 308. For example, sharp edges of surfaces in cavity 308 can be high wear areas when subjected to viscous media flow. Such areas can be configured to receive inserts that can be configured to be worn and/or periodically replaced. In certain additional examples, such inserts can also be of a different hardness or resilience than the rest of surfaces in cavity 308 and may, for example, be lower wearing than the rest of surfaces in cavity 308 and configured especially for viscous media flow. Additionally, other examples of tool body 302 can include any number of inserts.

Cut-outs 314A-D can divide shaping portion 306 into a plurality of members. Such a configuration can allow for individual members of shaping portion 306 to be replaced depending on, for example, wear or geometric constraints. Different members of shaping portion 306 can also be replaced depending on geometric needs of the final work piece. For example, work pieces of different final geometries can be formed within tool body 302 and, depending on the final geometries of the work piece, members of different shapes of shaping portion 306 can be inserted into stiffening portion 304.

Different members of shaping portion 306 can also be replaced depending on geometric needs of the final work piece. For example, work pieces of different final geometries can be formed within tool body 300 and, depending on the final geometries of the work piece, members of different shapes of shaping portion 306 can be inserted into stiffening portion 304.

Figure 4:
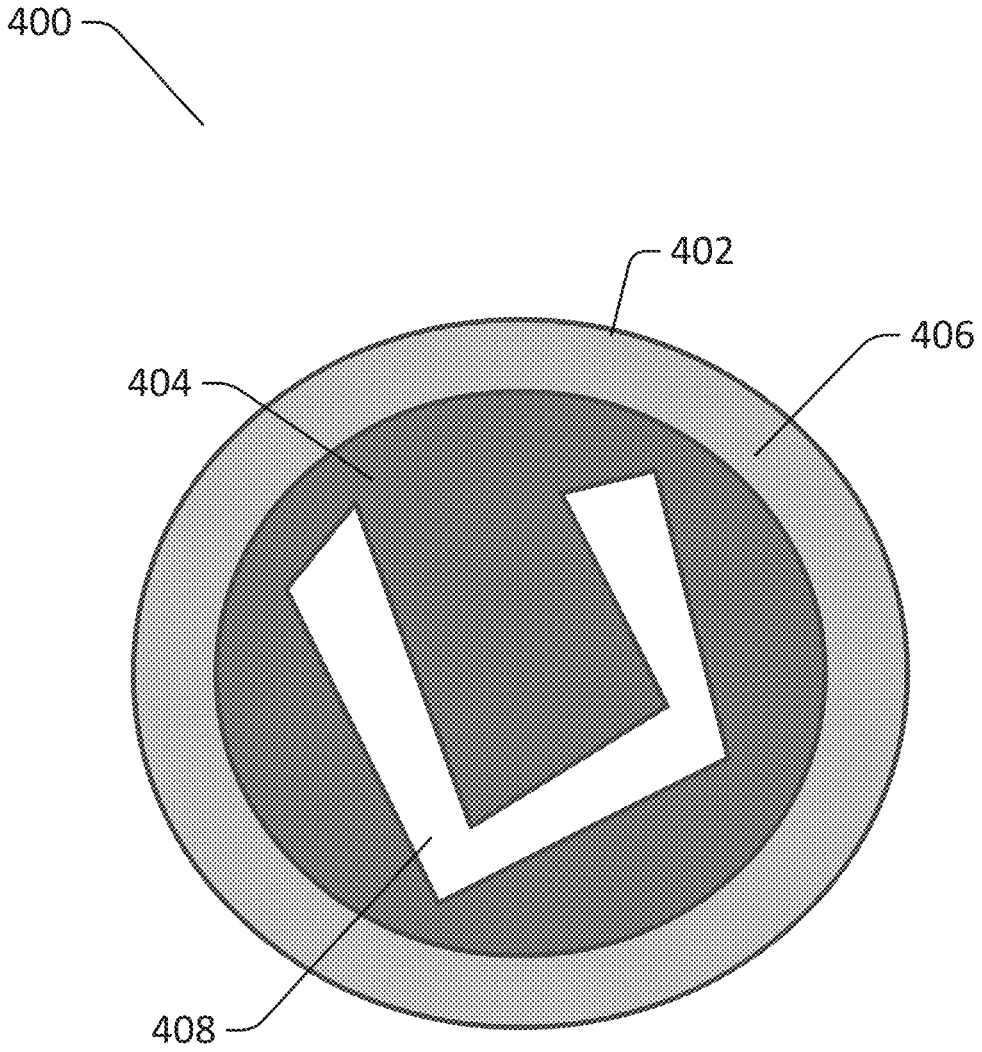
FIG. 4 illustrates a front view of a further tool body in accordance with an example of the disclosure.

FIG. 4 illustrates a front view of a further tool body in accordance with an example of the disclosure. FIG. 4 illustrates a tool body 400 that includes a two part tool 402. Two part tool 402 includes stiffening portion 404 and shaping portion 406. Shaping portion 406 includes cavity 408.

Cavity 408 is a different shape than cavity 308. As such, cavity 408 can be configured to form a work piece of a different final shape than that of cavity 308 due to the difference in shape/geometry of cavity 408 and cavity 308. Thus, different shaped cavities can be used if different final shapes of work pieces are desired.

Figure 5:
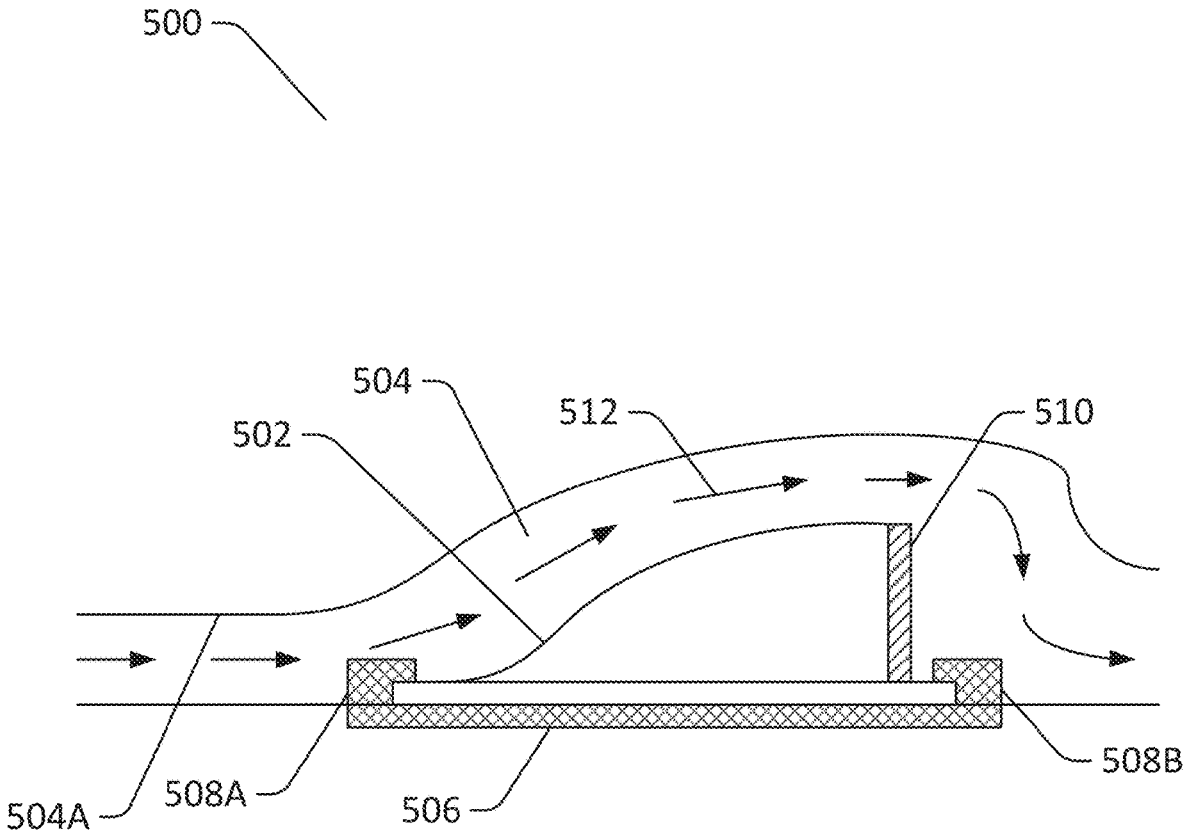
FIG. 5 illustrates a side cutaway view of a viscous machining tool during operation in accordance with an example of the disclosure.

FIG. 5 illustrates a side cutaway view of a viscous machining tool during operation in accordance with an example of the disclosure. FIG. 5 illustrates tool 500 that includes cavity 504, work piece base 506, work piece holders 508A and B, and work piece attachment 510. Work piece 502 can be placed atop work piece base 506 and held by work piece holders 508A and B.

Work piece attachment 510 can be coupled to work piece 502 to prevent wear on one or more surfaces of work piece 502. Thus, work piece attachment 510 can be attached to surfaces and/or edges of work piece 502 to prevent unwanted wear and/or rounding of corners of work piece 502. Work piece attachment 510 can be coupled via any of the techniques described herein. As such, work piece attachment 510 can be coupled mechanically, adhesively, magnetically, or through other techniques. In certain examples, work piece attachment 510 can be configured to be removable after forming of work piece 502. As such, work piece attachment 510 can be sacrificial to prevent wear to work piece 502 in certain areas where, without work piece attachment 510, work piece 502 can be worn by viscous media flow.

Work piece 502 can be placed atop work piece base 506 and held by work piece holders 508A and B. Work piece holders 508A and B can be placed over a portion of work piece 502 to hold work piece 502 in place. In certain examples, work piece holders 508A and B can be placed over and/or proximate portions of work piece 502 that will not be formed by viscous media flow. As such, work piece holders 508A and B can also protect such portions of work piece 502 from unintended wear by viscous media flow. Work piece base 506, work piece holders 508A and B, and work piece attachment 510 can be made from materials similar or identical to work piece 502 and/or made from materials different (e.g., harder) than work piece 502.

Viscous media flow can flow within cavity 504 through, for example, viscous media flow path 512. Cavity 504 can include coating 504A to prevent or slow wear of surfaces of cavity 504 from viscous media flow. Coating 504A can be a hard coating, material treatment (e.g., shot peening), a plating, a layer of hard material disposed on one or more portions of cavity 504, or other such technique to prevent or slow wear of the surfaces of cavity 504 from viscous media flow.

Viscous media flow can follow viscous media flow path 512 or other flow paths (not illustrated) within cavity 504. Portions of viscous media flow path 512 can pass over portions of work piece 502 and, accordingly, machine, wear away, or otherwise form work piece 502. Cavity 504 can include features configured to direct flow of viscous media. The features can allow for forming and/or machining of the outer surface of work piece 502 without undesired rounding of corners, build-up of residue, and/or other unwanted side effects of viscous media flow.

Viscous media flow used to form work piece 502 can include pre-determined characteristics such as a pre-determined flow rate and/or pressure or multiple pre-determined flow rates and/or pressures (e.g., different flow rates at different points of time), process time, and/or one or more viscous media used (e.g., viscous media that can wear work piece 502 at different rates can be used at different points of the process). Hence, such a process can include flowing a first viscous media at a first pressure for a first period of time and then switching to a second viscous media that will flow at a second pressure for a second period of time.

Such pre-determined characteristics can be determined through analysis prior to operation of tool 500. For example, geometry and characteristics of tool 500 and viscous media used can be modeled by, for example, computational fluid dynamics (CFD). Based on, at least, the starting geometry of work piece 502 and the geometry of cavity 504 and components within cavity 504, the characteristics such as flow rates and/or pressures, process time, viscous media used, and/or other characteristics can be determined so that viscous media flow can form work piece 502 to exhibit a desired final geometry. Such characteristics can then be used to operate tool 500 and, possibly, adjusted as needed.

Figure 6:
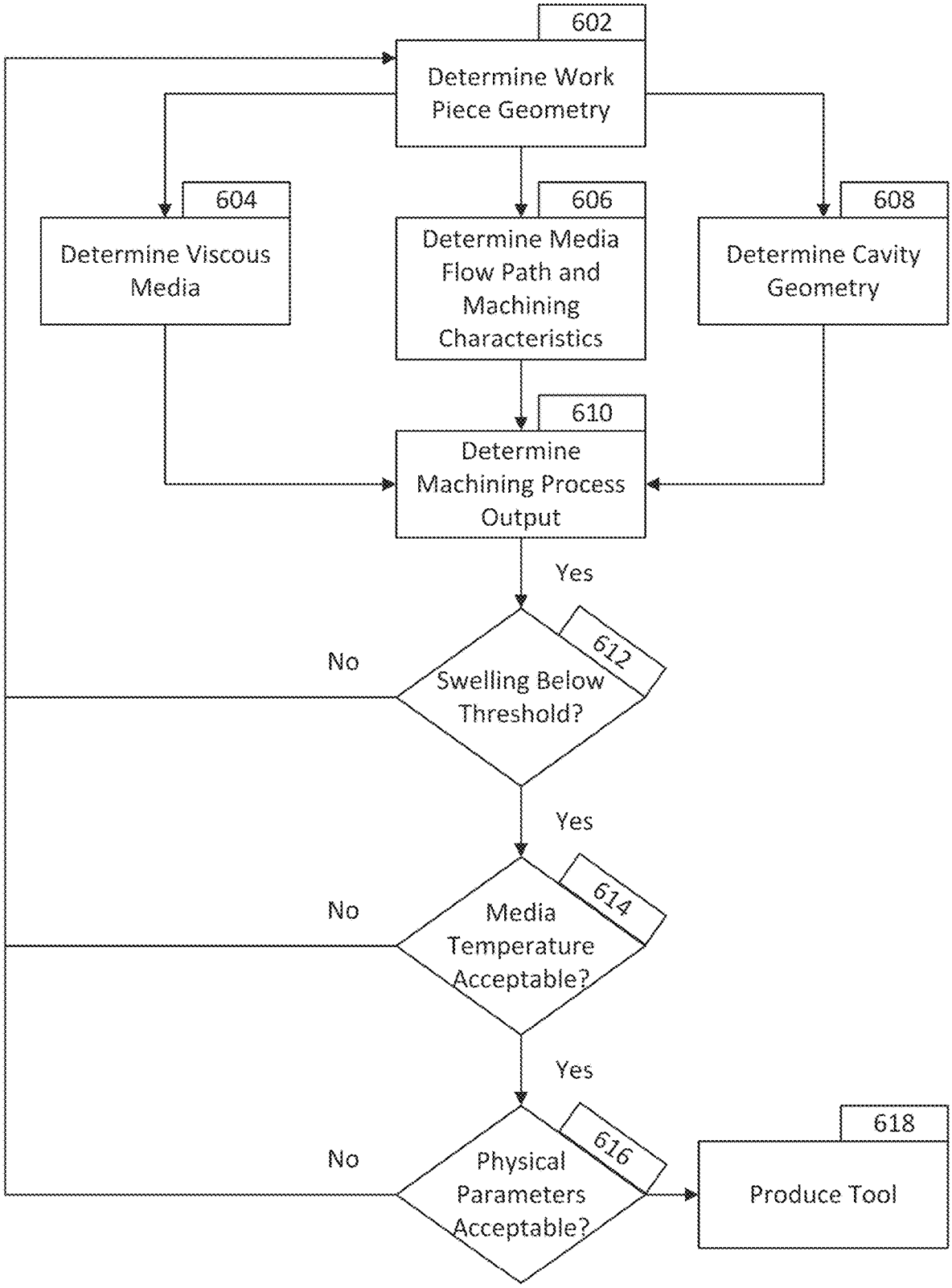
FIG. 6 is a flowchart detailing configuring of the media machining tool in accordance with an example of the disclosure.

FIG. 6 is a flowchart detailing configuring of the media machining tool in accordance with an example of the disclosure. One, some, or all of the steps detailed in FIG. 6 can be performed using certain design techniques. For example, characteristics related to viscous media flow such as machining characteristics and flow characteristics can be determined through CFD. Also, as detailed in block 602, the work piece geometry can be determined by, for example, computer aided design (CAD) to arrive at a final desired three dimensional shape of the work piece. In various examples, block 602 can include determine a starting and/or intermediate and/or final work piece geometry. The starting work piece geometry can be a geometry of the work piece when the work piece is first placed in the cavity. The final work piece geometry can be a desired geometry of the work piece after viscous flow machining has been performed.

After the final work piece geometry has been determined in block 602, characteristics of the tool can be determined. Such characteristics can include multiple different characteristics. For example, in block 604, viscous media to be used can be determined. The viscous media can be selected based on factors such as viscosity, abrasiveness, cost, flow rate, through put, work piece geometry desired, material of the work piece, and/or other such factors. Thus, for example, a work piece made from a softer material can be formed with less abrasive viscous media while a work piece made from a harder material can be formed with more abrasive viscous media.

In block 606, the viscous media flow path can be determined. The viscous media flow path can be determined based on the machining characteristics and/or the amount of machining desired for the work piece. For example, a starting work piece that includes a large amount required to be machined can thus require a media flow that includes abrasive viscous media and a media flow path that aggressively directs such media flow over the work piece (e.g., directs a large volume of media flow over the surface of the work piece and/or directs the media flow at a high pressure and/or flow rate). Other work pieces that require less machining can include a media flow path that less aggressively directs media flow over the work piece (e.g., directs a smaller volume of media flow over the surface of the work piece and/or directs the media flow at a lower pressure and/or flow rate). In certain examples, media flow within the media flow path can be varied (e.g., certain portions of the media flow path can include higher flow rates and/or pressures) to allow for different rates of work piece machining at different portions of the work piece.

In block 608, geometry of the cavity can be determined. The size of the cavity can be set to at least be configured to receive the work piece within the cavity. Such geometry can affect flow of viscous media within the cavity. For example, one or more features of the cavity can direct viscous media towards the work piece, around the work piece, away from the work piece, speed up or slow down the flow of the viscous media, increase or decrease pressure of the viscous media, create flow of certain pathways or characteristics, or affect viscous media flow in other ways. The positioning and number of inlets and outlets for viscous media flow into and out of the cavity can also be determined in block 608. Including multiple inlets and/or outlets can further fine-tune viscous media flow within the cavity.

In various examples, blocks 604, 606, and/or 608 can be separately performed and/or combined into one step in a process. For example, in another example, selection of viscous media in block 604 can be first performed. After the viscous media has been selected, the viscous media flow path, cavity geometry, and machining characteristics of the viscous media when flowing within the cavity through the viscous media flow path can be determined together.

After the work piece geometry, viscous media, viscous media flow path, desired level of machining, and cavity have been determined in blocks 602-608, the machining process can be analyzed. Such analysis can be performed through, for example, CFD. The work piece geometry, viscous media, viscous media flow path, and cavity geometry can be modeled in CFD and/or other such techniques and flow of viscous media can then be simulated. The results of the simulation can output the amount of machining and/or wear on the work piece due to viscous media flow, the amount of swelling of the work piece, the temperature of the viscous media, work piece, and/or cavity due to the flow of viscous media (e.g., from friction), the amount of viscous media used, the wear on the cavity surfaces and/or various attachments and/or holders used, and/or factors. Such factors can be analyzed in blocks 612-616.

In blocks 612-616, the swelling or distortion of the work piece, temperature of the viscous media, work piece, and/or cavity, the amount of machining and/or wear by the viscous media on the work piece, the amount of wear on the cavity surfaces and/or attachments and/or holders, and/or other such factors can be analyzed. All such factors can include threshold amounts. For example, there can be a maximum swelling amount, a maximum acceptable temperature for the viscous media, work piece, and/or cavity, a range of machining and/or wear required for the work piece, and/or a threshold amount of acceptable wear of the cavity surfaces and/or attachments. For example, the starting work piece geometry can be analyzed along with the characteristics of the viscous media, the viscous media flow path, and the cavity geometry, as well as other operational parameters (e.g., flow rate, pressure, operational time) to determine if the starting work piece can be formed to the desired final work piece geometry.

Additionally, the amount of deposits of residue on the work piece can also be determined and compared to threshold amounts. If any such factors are past the acceptable threshold, the work piece geometry, viscous media, viscous media flow path, machining characteristics desired, cavity geometry, and/or other such can be adjusted in blocks 602-608.

Thus, the process detailed in blocks 602-616 can be used to quickly analyze tool and/or cavity geometries and flow characteristics of viscous media flow and how flow of the viscous media interacts with work pieces. Such techniques can then be used to arrive at a tool and/or cavity geometry that allows for the work piece to be formed according to acceptable parameters. As viscous media flow tends to wear away all surfaces that it contacts, such a process allows for tools to be created that will form the work piece to the intended final geometry without creating unintended errors (e.g., rounding of corners).

The work piece can be designed to accommodate the machining/forming process such that particular portions of the work piece include more or less excess material to be removed during the machining/forming process, in view of the particular machining/forming parameters, such as post processing (e.g., drilling of holes, welding of additional parts, and/or other such processing) to be performed on the workpiece. Thus, the work piece can be subjected to additional forming before, during, or after flow machining.

Accordingly, the intended final geometry can include surfaces with additional materials and the additional materials can be removed (e.g., by post processing machining) to arrive at the desired part geometry. The intended final geometry can also include surfaces with less material than a final part and additional material can be added (e.g., welded on, mechanically fastened, and/or bonded) during post-processing to arrive at the desired part geometry. Furthermore, an initial geometry of the work piece (e.g., before any flow machining has been performed) can include geometries with excess material that can be partially or fully machined away by flow machining and post process machining. In certain examples, machining of certain surfaces may be performed during flow machining.

If analysis of the tool determines that analysis factors described herein are within acceptable parameters according to the thresholds, the process can continue to block 618 and the tool produced. The tool can then be coupled to various machinery (e.g., viscous media sources) and operated to produce the final geometry of the work piece.

Figure 7:
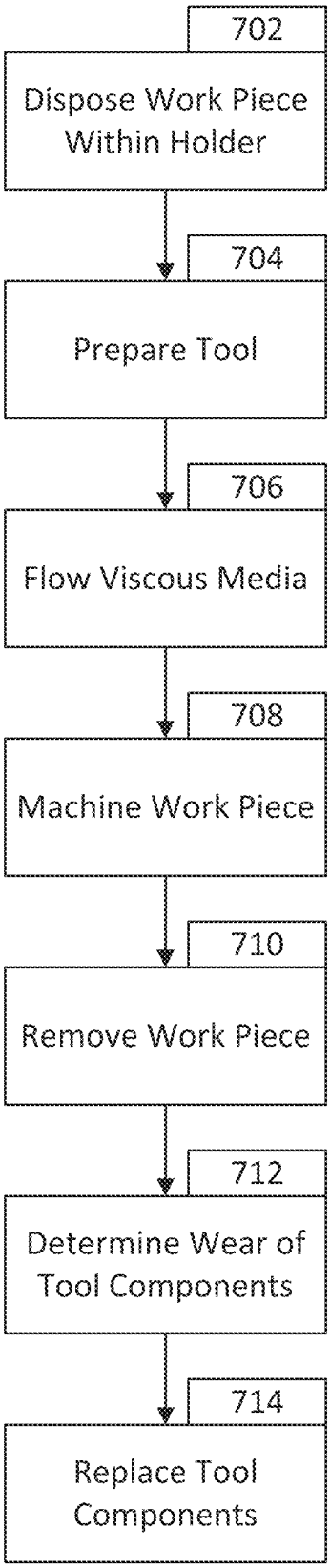
FIG. 7 is a flowchart detailing operation of the viscous media machining tool in accordance with an example of the disclosure.

FIG. 7 is a flowchart detailing operation of the viscous media machining tool in accordance with an example of the disclosure. In block 702, a work piece may be disposed within a cavity of the tool and held by a work piece holder.

In block 704, the tool can be prepared for operation by, for example, attaching any work piece attachments, closing of any doors to the cavity, connecting viscous media sources to the tool, and other such preparation.

In block 706, viscous media flow can be provided to the tool to flow into the cavity. Viscous media flow can machine and form the work piece in block 708. Thus, viscous media can form the work piece into a final geometry. In certain examples, the final geometry can be a geometry at the end of machining by viscous media flow and other post-process steps (e.g., drilling, attachment of additional components, chamfering, de-burring, and/or rounding of edges) can also be performed after machining by viscous media.

In block 710, after viscous media flow has stopped, the work piece can be removed from the cavity. The work piece can then be fully machined or ready for post-process. Wear of the inserts, attachments, holders, cavity surfaces, and/or other components of the tool can then be checked in block 712. Components exhibiting wear past an acceptable threshold can be replaced in block 714.

Examples described above illustrate but do not limit the invention. It should also be understood that numerous modifications and variations are possible in accordance with the principles of the present invention. Accordingly, the scope of the invention is defined only by the following claims.

What is claimed is:

1. An apparatus comprising:

a tool body comprising:

a cavity; and a work piece holder disposed within the cavity and configured to receive a work piece;

a seal door configured to move between a first position allowing access to the cavity and a second position preventing access to the cavity;

a first media entry configured to couple to a media source and allow media to flow into the cavity; and a first media exit configured to allow the media to flow out of the cavity, wherein the first media entry is a first point in a media flow path of the media and the media exit is a second point in the media flow path downstream of the first point, and wherein the work piece holder is configured to hold the work piece within the media flow path to be machined by the media;

wherein the cavity comprises a cavity surface comprising a curved portion that curves in downstream direction of the media flow path, the curved portion being positioned to be across the media flow path from a curved portion of a work piece surface of the work piece, the curved portions of the cavity surface and of the work piece surface guiding the media, when machining the work piece, to flow along the media flow path which curves, in the downstream direction, between the curved portions of the cavity surface and of the work piece surface along the curved portions of the cavity surface and of the work piece surface;

wherein the tool body further comprises:

a shaping portion comprising the cavity; and a stiffening portion configured to receive the shaping portion and stiffen the shaping portion, the stiffening portion completely enclosing the shaping portion in a cross-sectional view of the apparatus.

2. The apparatus of claim 1, wherein:

the shaping portion comprises a surface completely enclosing a void within the cavity in a cross-sectional view of the apparatus.

3. The apparatus of claim 1, wherein the shaping portion is configured to be removable from the stiffening portion, the stiffening portion being configured to accommodate different shaping portions with respective differently shaped cavities depending on a final geometry of the work piece.

4. The apparatus of claim 3, wherein the shaping portion is configured to affect the media flow path within the cavity.

5. The apparatus of claim 1, wherein the work piece holder is coupled to the shaping portion.

6. The apparatus of claim 1, wherein the tool body is made from a first material and at least the cavity further comprises a hardening coating disposed on the first material.

7. The apparatus of claim 1, further comprising:

a second media entry configured to allow media to flow into the cavity; and a second media exit configured to allow media to flow out of the cavity.

8. The apparatus of claim 1, wherein the media comprises at least one of an abrasive viscous media and a chemically erosive media; wherein the cavity is configured to vary a flow speed of the media at different portions of the work piece to provide respective different rates of work piece machining at the different portions of the work piece.

9. The apparatus of claim 1, wherein the cavity comprises one or more features configured to affect the media flow path, each feature comprising at least one of one or more protrusions and recesses directing the flow of the media, wherein the one or more features change the distance from the workpiece surface to the cavity surface in at least a part of the media flow path.

10. The apparatus of claim 1, further comprising the media source;

wherein the work piece comprises an interior channel whose surface is to be smoothed by the media machining the work piece.

11. The apparatus of claim 10, further comprising a controller communicatively coupled to the media source, wherein the controllers is configured to cause the media source to flow the media into the cavity for a pre-determined amount of time.

12. A method of using the apparatus of claim 1, the method comprising: positioning a work piece to be held by the work piece holder; moving the seal door to the second position; flowing the media into the cavity; and machining the work piece with the media flowing through the media flow path, wherein the media flows at different flow speeds at respective different portions of the work piece, and the media machines the different portions of the work piece at respective different machining rates.

13. A method of using the apparatus of claim 1, the method comprising:

positioning a work piece to be held by the work piece holder;

moving the seal door to the second position;

flowing the media into the cavity; and machining the work piece with the media flowing through the media flow path;

wherein the tool body further comprises a shaping portion comprising the cavity and a stiffening portion configured to receive the shaping portion and stiffen the shaping portion, the method further comprising:

determining that wear of the shaping portion is past a wear threshold;

removing the shaping portion from the stiffening portion; and coupling a second shaping portion with wear less than the wear threshold to the stiffening portion.

14. The method of claim 13, further comprising:

determining a machined work piece shape;

selecting the shaping portion from a plurality of shaping portions of different geometries in response to the determining the machined work piece shape; and coupling the shaping portion to the stiffening portion.

15. A method comprising manufacturing the apparatus of claim 1, wherein the manufacturing comprises:

determining a geometry of a tool body comprising a cavity and a work piece holder disposed within the cavity and configured to receive a work piece;

determining a starting geometry of the work piece;

determining characteristics of a media;

determining a media flow path of the media within the cavity when the work piece holder within the cavity receives the work piece; and determining machining characteristics of the media flow path of the media on the work piece.

16. The method of claim 15, wherein the determining the geometry of the tool body comprises determining a configuration of a shaping portion of the tool body, wherein the shaping portion is configured to be disposed within the media flow path and configured to affect the media flow path.

17. The method of claim 16, wherein the determining the geometry of the tool body further comprises determining a geometry of a wearable portion of the shaping portion and wherein the method further comprises:

determining machining characteristics of the media flow path of the media on the wearable portion.

18. The method of claim 15, wherein the determining the machining characteristics comprise determining that an amount of erosion from a first portion of the work piece is above a first erosion threshold and/or determining that a swelling of a first portion of the work piece is below a first swelling threshold and wherein the determining the media flow path comprises determining a placement of a media entry relative to the work piece holder.

19. The method of claim 15, further comprising:

determining a cavity geometry of the cavity from a final geometry of the work piece and the characteristics of the media.

20. An apparatus comprising: a tool body comprising: a cavity; and a work piece holder disposed within the cavity and configured to receive a work piece; a seal door configured to move between a first position allowing access to the cavity and a second position preventing access to the cavity; a first media entry configured to couple to a media source and allow media to flow into the cavity; and a first media exit configured to allow the media to flow out of the cavity, wherein the first media entry is a first point in a media flow path of the media and the media exit is a second point in the media flow path downstream of the first point, and wherein the work piece holder is configured to hold the work piece within the media flow path to be machined by the media; wherein the cavity comprises a cavity surface comprising a curved portion that curves in downstream direction of the media flow path, the curved portion being positioned to be across the media flow path from a curved portion of a work piece surface of the work piece, the curved portions of the cavity surface and of the work piece surface guiding the media, when machining the work piece, to flow along the media flow path which curves, in the downstream direction, between the curved portions of the cavity surface and of the work piece surface along the curved portions of the cavity surface and of the work piece surface; wherein the tool body further comprises: a shaping portion comprising the cavity; and a stiffening portion configured to receive the shaping portion and stiffen the shaping portion; wherein the cavity comprises one or more features configured to affect the media flow path and flow speed, each feature comprising at least one of one or more protrusions and recesses directing the flow of the media, wherein the one or more features change the distance from the workpiece surface to the cavity surface in at least a part of the media flow path.

21. The apparatus of claim 20, wherein the shaping portion is configured to be removable from the stiffening portion.

* * * * *